United States Patent [19]

Figliuzzi

[11] Patent Number: 4,660,513

[45] Date of Patent: Apr. 28, 1987

[54] TIMING ADJUSTED ENGINE AND CONVERSION KIT THEREFOR

[75] Inventor: Vincent D. Figliuzzi, Elmhurst, Ill.

[73] Assignee: Vindof Incorporated, Elmhurst, Ill.

[21] Appl. No.: 801,880

[22] Filed: Nov. 26, 1985

[51] Int. Cl.[4] ..... F02B 33/38; F02D 39/04

[52] U.S. Cl. ..... 123/65 A; 123/65 VD

[58] Field of Search ..... 123/65 A, 65 BA, 65 VD, 123/65 V, 65 P, 65 R

[56] References Cited

U.S. PATENT DOCUMENTS

| | | | |
|---|---|---|---|
| 1,892,124 | 12/1932 | Abell | 123/65 BA |
| 2,189,106 | 2/1940 | Garve et al. | 123/65 BA |
| 4,386,587 | 6/1983 | Simko | 123/65 VD |

FOREIGN PATENT DOCUMENTS

| | | | |
|---|---|---|---|
| 460591 | 6/1928 | Fed. Rep. of Germany | 123/65 VB |
| 392733 | 3/1934 | Fed. Rep. of Germany | 123/65 BA |
| 894433 | 12/1944 | France | 123/65 BA |

*Primary Examiner*—Charles J. Myhre
*Assistant Examiner*—David A. Okonsky
*Attorney, Agent, or Firm*—Hill, Van Santen, Steadman & Simpson

[57] ABSTRACT

A two cycle internal combustion piston engine is provided with cam controlled inlet valves, as well as exhaust valves, disposed in the head of the engine cylinder. The two cycle engine can perform with an expansion ratio greater than the compression ratio. A standard two cycle internal combustion piston engine can be converted to the inventive two cycle engine construction by replacing the conventional engine cylinder head, replacing the conventional engine valve cam shaft, and directing air flow in the intake manifold to one side of the replacement cylinder head.

4 Claims, 7 Drawing Figures

TIMING ADJUSTED ENGINE AND CONVERSION KIT THEREFOR

BACKGROUND OF THE INVENTION

The invention relates to an internal combustion piston engine and, more particularly, to a new two cycle engine construction which allows a greater proportion of work to be extracted from the hot gases and a method and assembly for converting a conventional two cycle piston engine to the new construction.

Conventional Otto and Diesel cycle internal combustion piston engines theoretically operate with equal compression and expansion ratios in the cylinder. The inefficiency of these conventional engines is principally due to the degree of heat in the gases rejected from the cylinder at the end of the expansion stroke. There is a theoretical cycle sometimes referred to as "partial charging" or the Atkinson cycle which allows a greater proportion of work to be extracted from the hot gases by causing the expansion ratio to be greater than the compression ratio. An engine operating in this type of cycle would have lower energy losses and hence improved thermal efficiency.

The conventional two cycle internal combustion engine is a reciprocating piston and cylinder arrangement wherein the engine chamber is defined between an end wall or head on the cylinder and the piston. The head is fitted with a plurality of exhaust valves for hot gas evacuation and a fuel injector for introducing fuel into the chamber. The opening and closing of the fuel injector and exhaust valves is controlled by cams on a rotary shaft. An air inducer, such as a Roots blower, serves to provide a supply of pressurized air in an intake manifold to be passed into the chamber. The air intake into the chamber is through inlet ports, laterally formed in the cylinder wall adjacent the bottom dead-center position of the piston in the chamber and controlled by the piston. The two cycle engine operation is such that, upon combustion, the piston commences its power stroke moving away from the cylinder head. The power stroke is completed upon opening of the exhaust valves which occurs before the piston reaches the inlet ports. As the piston continues movement away from the head, the inlet ports are uncovered to introduce pressurized air into the chamber. From beneath the inlet ports, the piston begins its stroke toward the cylinder head. As the piston covers the inlet ports, the exhaust valves are closed and the piston starts its compression stroke, leading to combustion. The use of only sidewall parts for an intake requires that the compression stroke of the piston be equal or very nearly equal to the expansion or power stroke of the piston.

Heretofore, little consideration has been paid to two cycle engines for Atkinson cycle operation. It has not been practicable to utilize the Atkinson cycle in a conventional two cycle engine construction, since a considerable power loss ensues. The expansion ratio can be made greater than the compression ratio by holding open the exhaust valves for some time after the inlet ports have been covered by the piston; however there is substantial loss of pressure in the intake air which remains in the chamber after the exhaust valves are finally closed.

The present invention concerns a two cycle engine construction which is capable of practical performance with an expansion ratio greater than the compression ratio. By operating the two cycle engine of the present invention on a fundamentally more efficient thermal cycle, specific fuel consumption is improved and the engine runs cooler and is less polluting. The present invention also concerns a method and assembly for modifying standard two cycle engine constructions such that the resultant two cycle engine is capable of practical performance with an expansion ratio greater than the compression ratio.

SUMMARY OF THE INVENTION

In a two cycle internal combustion engine having at least one reciprocating piston and cylinder arrangement (the cylinder having a cylinder head opposed from said piston to define a chamber therebetween), fuel injection means for introducing fuel the chamber, exhaust valve means for hot gas evacuation from the chamber, and an air manifold for providing a supply of pressurized air to be communicated to the chamber, the cylinder wall has side inlet ports for air intake to the cylinder chamber of relatively reduced cross-sectional opening than heretofore known, and inlet valve means are disposed in the cylinder head. The inlet valves means are set to open and close as desired regardless of the position of the piston in the cylinder. This inventive assembly permits a selective controlled introduction of fully pressurized air into the cylinder subsequent to some air scavenging by air introduced through the side inlet ports. Thus, a "partial charging" operation can be brought about in a two cycle internal combustion engine setting without impermissible power loss. Upon movement of the piston in a downstroke for power take-off, the exhaust valve means are opened as, or just before, the piston commences to uncover the side inlet ports which are adjacent the bottom dead-center position of the piston in the cylinder chamber. The exhaust valve means remain open as the piston completes its downstroke and commences on upstroke, recovering the side inlet ports. Pressurized air introduced into the chamber during opening of the side ports serves to scavenge the hot gases in the chamber, but the amount of air introduced through the side ports is less than that required for completion of the engine operation. With the exhaust valve means remaining open and the piston continuing on its upstroke, the intake valve means are opened to introduce further pressurized air into the chamber to introduce further pressurized air into the chamber to complete the scavenging and supply the remaining air requirements for the engine operation. The exhaust valve means is subsequently closed, depending upon the degree of "partial charging" desired, to commence the compression stroke ending in combustion and repetition of the engine operation.

A standard two cycle internal combustion piston engine can be converted to the present invention arrangement. A new cylinder wall is used with side parts of relatively small cross-section. At least one of the original set of exhaust valves is converted to an intake valve by application of a special partitioned cylinder head, a modified cam control, and an added air duct connecting the conventional air manifold with the intake valve portion of the special cylinder head.

A standard two cycle internal combustion piston engine is converted to a further invention arrangement by eliminated conventional cylinder wall intake ports and providing inlet valve means. The closure of the inlet valve means is delayed to spill induced air from the cylinder prior to inlet valve closure and compression.

At least one of the original set of exhaust valves is converted to an intake valve by application of a special partitioned cylinder heat element, a modified cam control, and modified ducting from the blower or inducer.

Other advantages, features, and modifications of the present invention are set forth in the detailed description which follows.

DETAILED DESCRIPTION OF THE PREFERRED EMBODIMENTS

Figure 1:
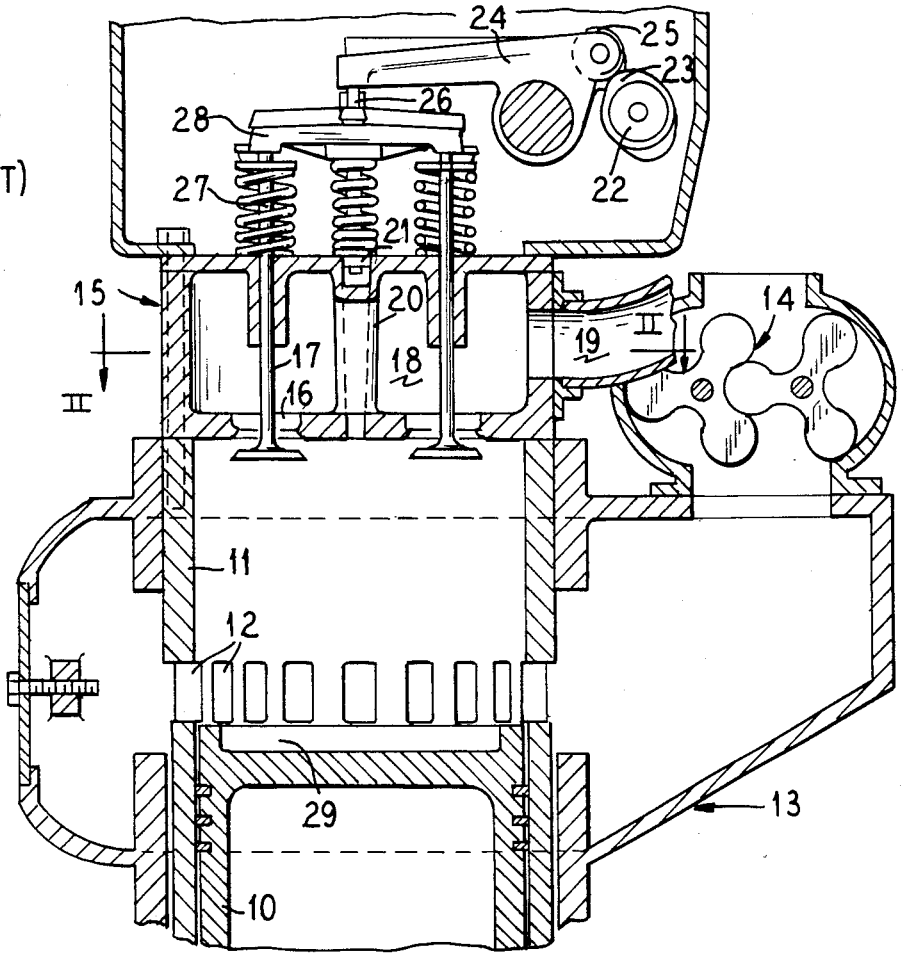
FIG. 1 (PRIOR ART)
FIG. 1 is a side elevational, cross-sectional view showing a conventional two cycle internal combustion piston engine construction.
Figure 2:
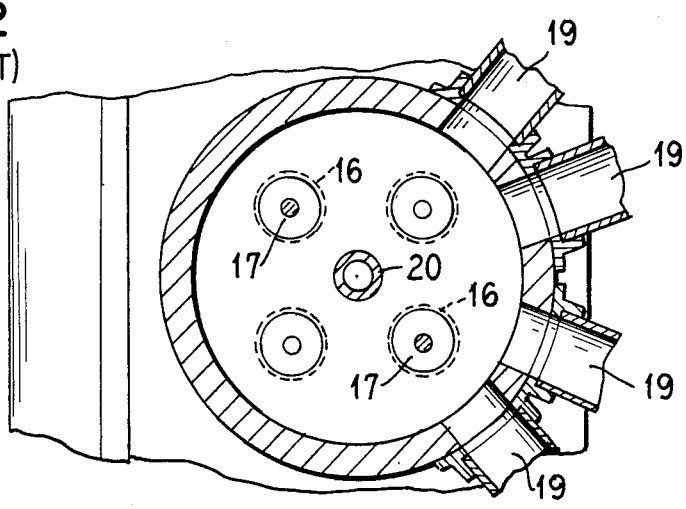
FIG. 2 (PRIOR ART)
FIG. 2 is a cross-sectional view taken along the lines II—II of FIG. 1.

FIGS. 1 and 2 show a conventional Otto or Diesel-type two cycle internal combustion piston engine construction in which a piston 10 reciprocates in a cylinder 11. The cylinder has inlet ports 12 of conventional sized opening cross-section disposed about the cylinder wall controlled by the piston 10. Air flow is directed to the cylinder chamber from an inlet manifold means 13 disposed about the cylinder 11 and in open communication with the intake ports 12. The intake air is pressurized by a blower or inducer device, such as a Roots blower 14, which delivers air to the intake manifold 13.

The top of the cylinder 11 is closed by a cylinder head 15 containing four through holes 16 which are opened and closed by exhaust valves 17. The through holes 16 extend between the cylinder chamber and an evacuation space 18 formed in the cylinder head and connected to an exhaust manifold through exhaust passages 19. The cylinder head 15 is also centrally fitted with a suitable fuel injection duct 20 having a passage way leading to the cylinder chamber. Flow through the fuel injection passage is controlled by a fuel valve 21.

The opening and closing of the fuel and exhaust valves is cam controlled. A rotary cam shaft 22, rotating at the speed of the main engine shaft, is formed with a series of individual cam eccentrics 23 spaced apart from one another along the length of the shaft 22. Associated with each of the eccentric cams is a pivot arm 24, one end of which is disposed with a cam follower surface 25 while the other end operates a control rod 26 normally biased upward by springs 27 associated with the valves. The control rod associated with the pivot arm operating the fuel injector valve acts directly on the fuel injector valve, whereas the exhaust valves are divided into pairs and operated simultaneously by a yoke 28 interconnecting the control rod 26 with two exhaust valves 17.

In accordance with conventional construction practices, the top surface of the piston 10 is formed with a central recess area 29 to define a combustion space at the top of the compression stroke. This piston recess space 29, however, reduces the effective compression ratio of the piston cylinder arrangement.

Figure 3:
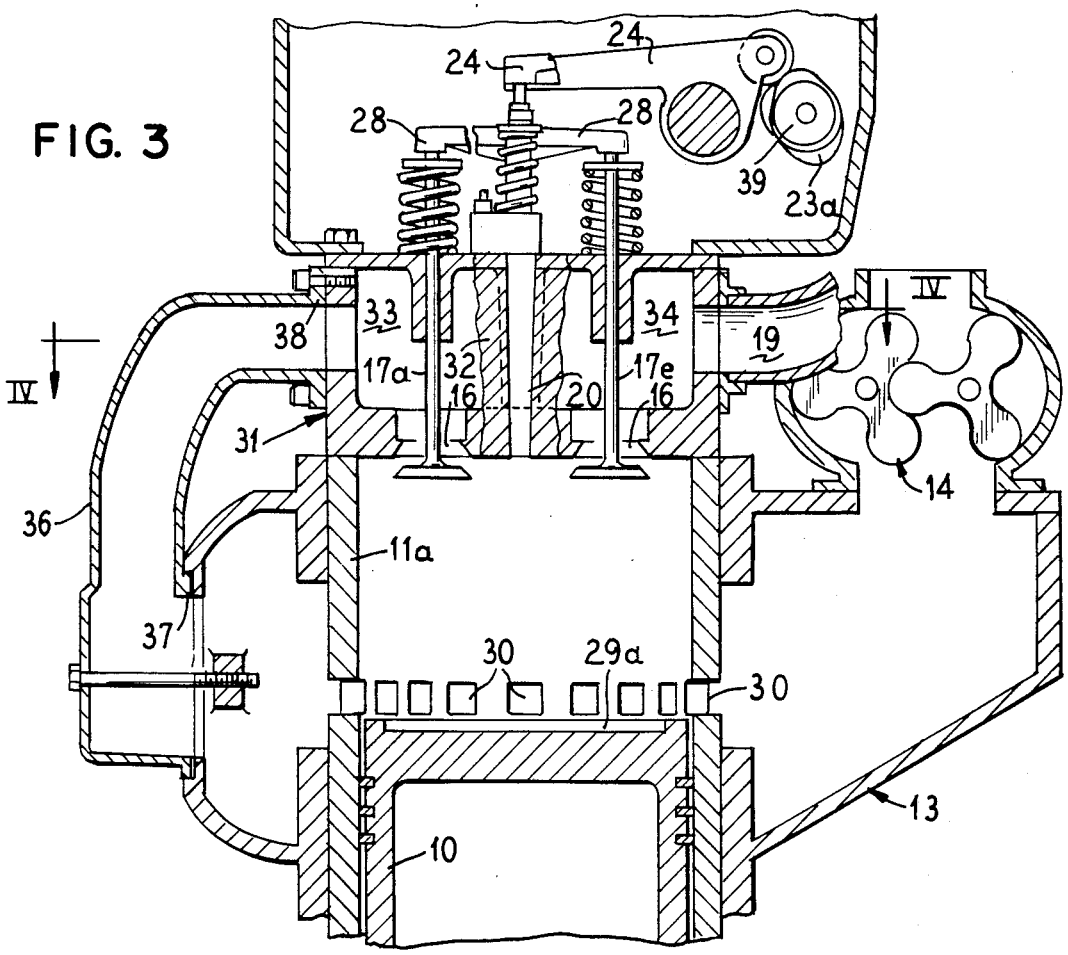
FIG. 3 is a side elevational, cross-sectional view illustrating the present invention two cycle engine construction.
Figure 4:
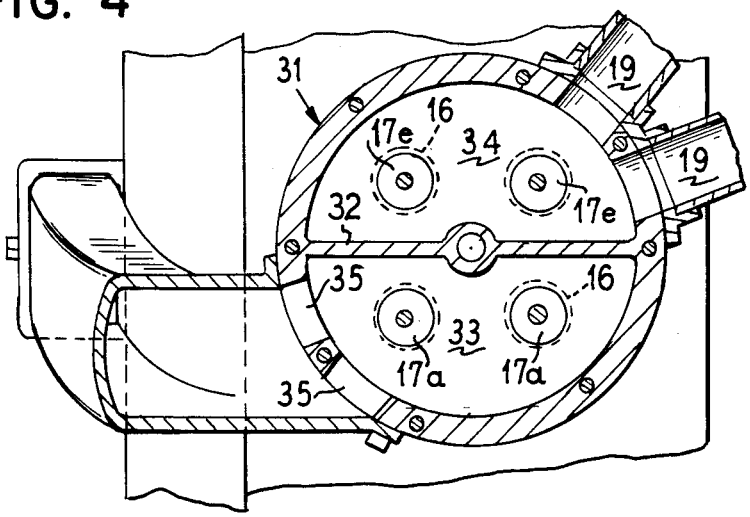
FIG. 4 is a cross-sectional view taken along the lines IV—IV of FIG. 3.

The two cycle engine of FIGS. 1 and 2 operates in the conventional manner with air intake being controlled by movement of the piston 10 past the ports 12 and rejection of hot gases being controlled by operation of the exhaust valves 17. The expansion and compression ratios are equal or very close to equal in conventional practice FIGS. 3 and 4 show a two cycle internal combustion piston engine construction in accordance with the present invention. This inventive construction may be the result of original manufacture, or brought about by converting a standard two cycle engine construction (such as shown in FIGS. 1 and 2) as further discussed below. To the extent standard features of the conventional-type two cycle engine reoccur in the inventive engine construction, the reference numerals from the description of FIGS. 1 and 2 are shown. The inventive engine construction of FIGS. 3 and 4 is applicable to compression ignition and spark ignition operations. The inventive two cycle engine differs from conventional two cycle constructions in that: (1) the cylinder wall has side inlet ports of cross-sectional opening significantly reduced (about 50%) in size compared to conventional side ports; (2) ducting connects the air intake manifold to the cylinder head; (3) the cylinder head interior has a partition wall defining separate air intake and hot gas evacuation spaces in separate controlled communication with the cylinder chamber, and (4) there is separate cam shaft control for the cylinder head intake and exhaust valves, respectively. The inventive construction readily lends itself to a "partial charging" or Atkinson cycle engine operation. Inlet ports on the cylinder sidewall exist only to permit the introduction of some of the amount of air to pass into the chamber for scavenging. The intake valves only operate after upstroke piston movement toward the cylinder head has commenced and the side inlet ports have been or are being closed. Preferably, the piston 10 used in the invention assembly is configured with a significantly smaller recess space 29A, in contrast to the conventional piston recess 29, to increase volumetric compression efficiency in the cylinder. The inventive cylinder head has a relatively flat surface facing into the cylinder chamber which permits a smaller piston recess 29A to be used.

The invention side inlet ports 30 are formed in a sidewall of a cylinder 11A. As indicated by comparing FIG. 3 with FIG. 1, the cross-sectional opening of the ports 30 is significantly reduced (preferably about a 50% reduction) as compared to convention side port openings 12.

The conventional cylinder head is replaced by a cylinder head 31 of inventive construction. With reference to FIG. 4, the cylinder head 31 has an interior formed with partition wall 32 defining sealably isolated first and second interior spaces 33 and 34, respectively. Each of the interior spaces 33 and 34 contains a pair of through holes 16 leading to the cylinder chamber which are opened and closed by the operation of a pair of valves simultaneously operated through the yoke 28 by a common pivot arm 24. The interior space 33 serves as an air intake passage and the valves 17A extending through that space operate as air intake valves for the inventive two cycle engine construction. The interior space 34 serves as the exhaust space in the cylinder head and the pair of valves 17E extending through that space operate as exhaust valves for hot gas evacuation from the cylinder chamber.

The exhaust space 34 is connected to the exhaust manifold through exhaust passages 19. The cylinder head wall encompassing the intake space 33 is formed with inlet ports 35 which communicate with the air intake manifold 13 through a connection duct open at one end 37 for receiving induced air from the intake manifold 13 and open at the other end 38 for suitable attachment to the cylinder head for passing air through the ports 35 into the intake space 33.

In accordance with the invention, a rotary cam shaft 39 is provided for actuating the pivot arms controlling operation of the fuel injector, air intake valves 17A, and exhaust valves 17E. The cam shaft 39 is fitted with at least three individual sets of cams 23A for respectively operating the fuel injector, intake valve means, and exhaust valve means. The lobe profiles of these cams 23A may be selectively designed to bring about the desired timing of operations.

For example, to effect one form of "partial charging" engine operation in which the expansion ratio is about twice the compression ratio, considerably less fuel then the conventional fuel amount is utilized per engine cycle, depending upon stroke and size of the ports 30, amounting to approximately 20–30% fuel savings. A suitable fuel injector is utilized. The eccentric profile on the cam controlling the pivot arm operating the exhaust valves 17E is designed to open the exhaust valves 17E just before or as the piston 10 has reached the inlet ports 30. The ports 30 are uncovered by the piston and pressurized air from the manifold 13 is introduced into the cylinder chamber for scavenging. The exhaust valves 17E remain opened as the piston proceeds on its upstroke, reclosing the ports 30. The eccentric profile on the cam controlling the pivot arm operating the inlet valves 17A is designed to open the inlet valves 17A as or immediately after the piston closes the ports 30 to complete scavenging and supply the chamber with pressurized air for compression. The cam profiles are designed to hold open the exhaust and inlet valves until the piston upstroke has proceeded to the desired point for compression to commence which, for this illustration, would be when the piston has completed half of its upstroke. At this point, the inlet and exhaust valves 17A and 17E close, simultaneously or in close sequence. As the piston nears the end of its upstroke, the fuel injection valve is opened to introduce the fuel to the cylinder chamber, followed by combustion and the piston movement turning to downstroke for the expansion or power cycle.

Figure 5:
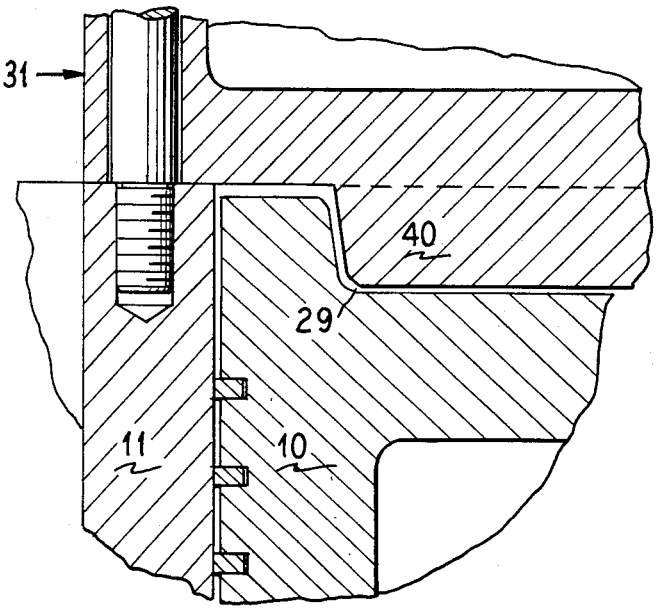
FIG. 5 is a fragmentary side elevational, cross-sectional sectional view illustrating a cylinder head having an inwardly protruding lip portion in accordance with the present invention.

A further feature of the present invention, shown by FIG. 5, is contemplated in the event a conventional piston 10 is used in the invention assembly having a relatively deep piston recess 29 (FIG. 1) than preferred for this invention. In this event, in order to recover some of the lost compression ratio due to the extended period during which the valves 17A and 17E are open, the cylinder head 31 may be formed with an inwardly protruding lip 40 for taking up the conventional piston recess area 29. The through holes 16 of the cylinder head extend through the bottom wall of the cylinder head and this lip portion 40 and the valves operate at the lower open end of the through holes in the lip. Alternatively, to the same effect, the piston recess area 29 could be replaced with an upward protuberance and the cylinder head surface facing the cylinder chamber formed with a matching recess area for a piston protuberance.

Figure 6:
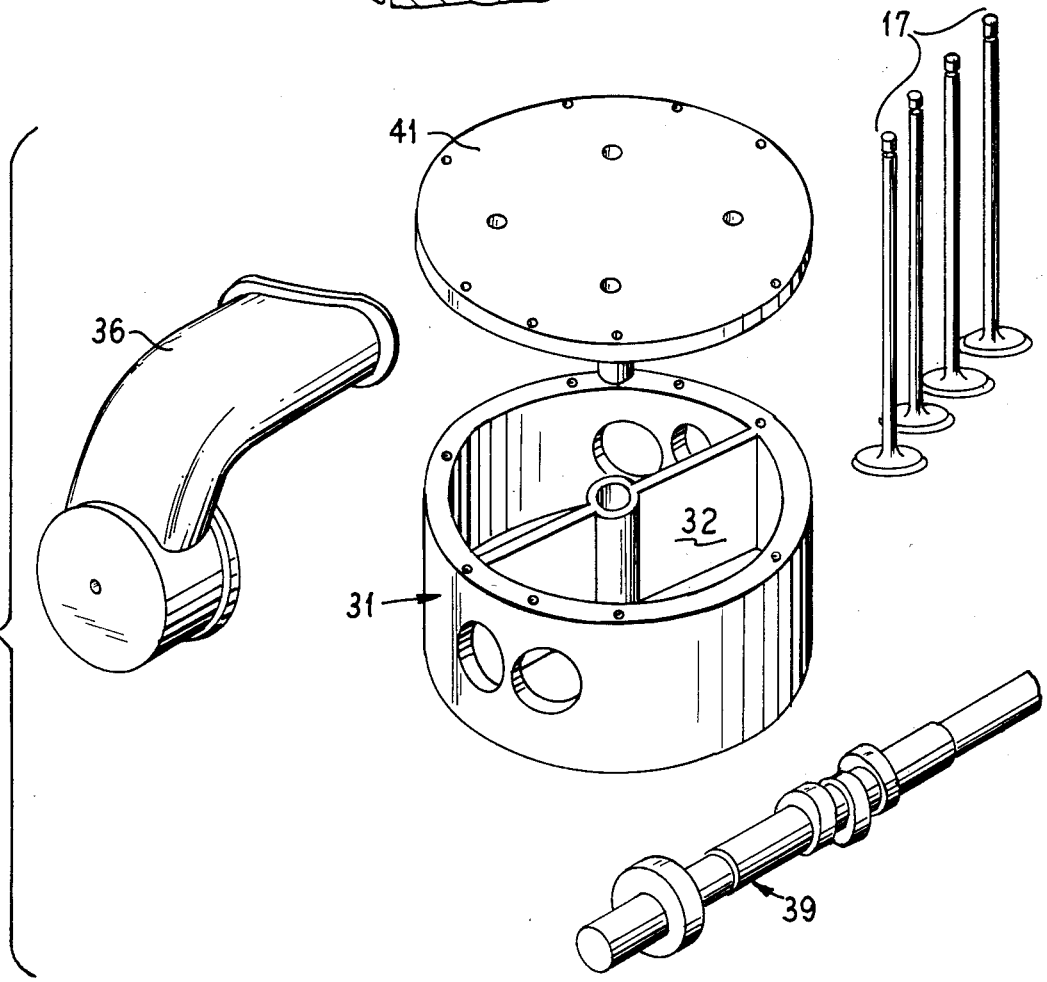
FIG. 6 is a broken away side elevational assembly view of conversion kit elements in accordance with the present invention.

The present invention two cycle internal combustion engine construction may be brought about by modifying a conventional two cycle engine construction with replacement parts as shown in FIG. 6. The inventive conversion kit comprises the modified cylinder head 31 for replacing the conventional two cycle engine cylinder head. The inventive modified cylinder head 31 may be incorporated with the inwardly protruding lip portion feature of FIG. 5 and provided to enable the user to continue to use the top wall 41 and valve elements 17 of the cylinder head mechanism being replaced. The invention kit would include a form of extension duct 36 for routing induced air from the conventional intake manifold to the intake space of the new cylinder head construction. The cam shaft 22 of the conventional engine construction would be replaced with the modified cam shaft 39 to bring about an inlet valved operation for a two cycle internal combustion engine.

Figure 7:
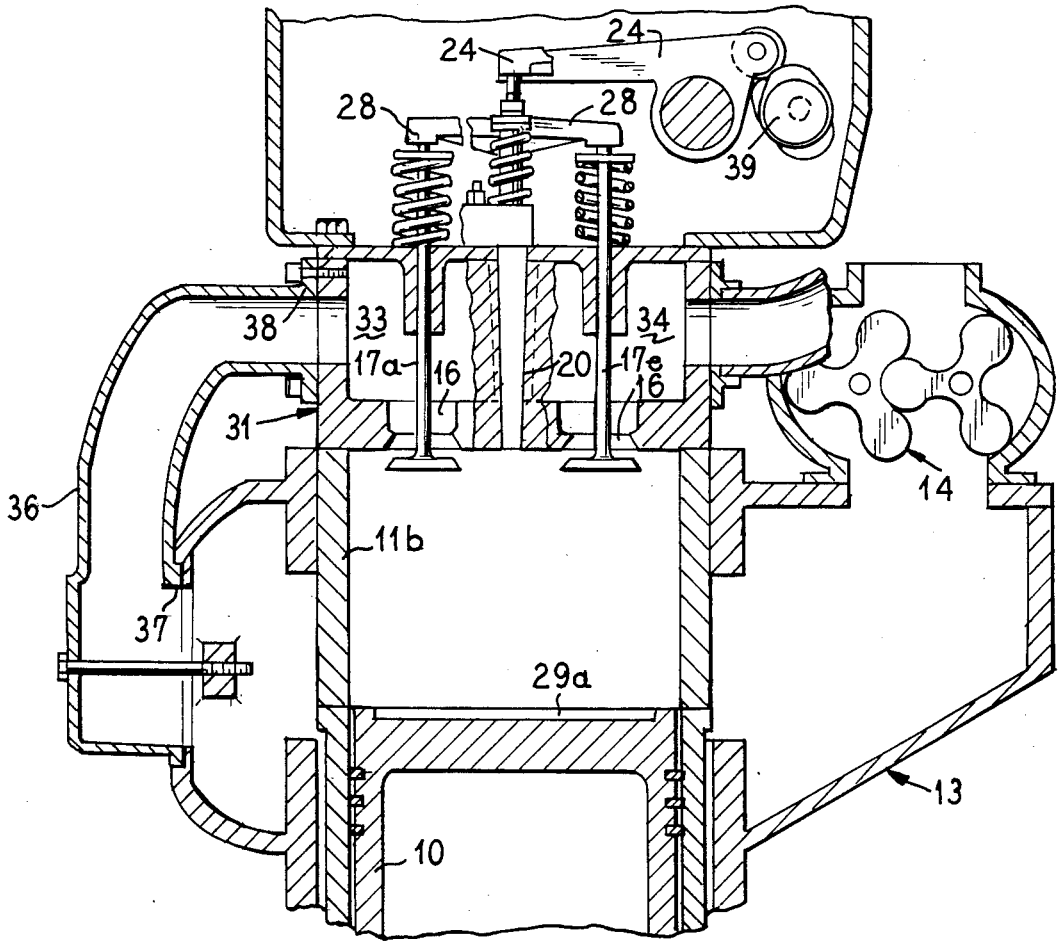
FIG. 7 is a cross-sectional view of a further invention embodiment wherein the two cycle engine does not utilize cylinder wall side ports.

FIG. 7 shows a further two cycle internal combustion piston engine construction in accordance with the present invention brought about by converting a conventional two cycle engine construction, such as shown in FIGS. 1 and 2, as further discussed below. Like reference numerals from the previous discussion are shown, where applicable. The invention engine construction construction of FIG. 7 is applicable to compression ignition and spark ignition operations. This inventive two cycle engine differs from conventional two cycle constructions in that: (1) the cylinder wall 11 is no longer ported; (2) special ducting now connects the air intake manifold to the cylinder head 15; (3) the cylinder head now has a partition wall defining separate air intake and hot gas evacuation spaces in separate controlled communication with the cylinder chamber, and (4) a cam shaft control mechanism for the cylinder head valves is modified to bring about a "partial charging" or Atkinson cycle engine operation. For purposes of illustration and in accordance with the preferred embodiment, the inventive two cycle engine operation will be described in terms of utilizing only one-half of the piston displacement for actual compression and the full piston displacement for exansion. In other words, the hot gases in the engine are expanded to twice the volume of the effective compression.

A solid, unported cylinder wall 11B is provided to eliminate the presence of intake ports in the cylinder wall. Alternatively, a sleeve or ring may be wrapped around the outer wall of a conventional cylinder 11 to seal off conventional intake ports 12 from communication with the air intake manifold.

The conventional cylinder head is replaced by the cylinder head 31 of inventive construction. The cylinder head wall encompassing the intake space 33 is formed with inlet ports 35 which communicate with the air intake manifold 13 through a connection duct open at one end 37 for receiving induced air from the intake manifold 13 and open at the other end 38 for suitable attachment to the cylinder head for passing air through the ports 35 into the intake space 33.

In accordance with the invention, the rotary cam shaft 39 is provided for actuating the pivot arms controlling operation of the fuel injection, air intake, and exhaust valves. The profiles for the eccentric cams on the cam shaft 39 are modified with respect to the eccentric cam profiles for a conventional two cycle engine cam shaft to extend the period during which the inlet valves 17A are open. The profile for the eccentric cam operating the exhaust valves 17E may be the same as employed for operating exhaust valves in a conventional two cycle engine. The eccentric cam used to operate the inlet valves 17A is formed with a protuberance profile which is substantially flat at its apex. This flattened area of the profile maintains the position of its pivot arm against return of the inlet valve spring action to delay the closure of the inlet valves 17A thereby spilling induced air from the cylinder chamber back into the air intake space 33 during the first half of the piston compression stroke. As the piston nears the end of its first half compression stroke, the profile of the eccentric cam controlling the inlet valves recedes from its protuberance to close the inlet valves from communication with the cylinder head space 33 and permit compressive work to be done on the air within the cylinder chamber during the remainder of the compression stroke. Since the compression starts at half the maximum volume of the cylinder chamber, the effective compression ratio is reduced to half the original for a similarly sized two cycle engine of conventional construction.

This FIG. 7 invention two cycle internal combustion engine construction is brought about by modifying a conventional two cycle engine construction with replacement parts as shown in FIG. 6 and, in addition, a replacement solid wall cylinder 11B. Alternatively to the solid cylinder piece, a sleeve may be provided as part of the invention kit to close up the air inlet ports 12 on the conventional two cycle cylinder. This invention kit must include a form of extension duct 36 for routing induced air from the conventional intake manifold to the intake space of the new cylinder head construction.

Although various minor modifications may be suggested by those versed in the art, it should be understood that I wish to embody within the scope of the patent warranted hereon all such modifications as reasonably and properly come within the scope of my contribution to the art.

I claim as my invention:

1. A conversion package for modifying a two cycle internal combustion piston engine construction having a piston reciprocable in a cylinder, said cylinder having a cylinder head opposed from said piston to define a chamber therebetween and sidewalls formed with open ports controlled by said piston, a plurality of exhaust valve means for said chamber supported in said cylinder head controlled by cams on a rotating cam shaft, a fuel injection means in said cylinder head, and an air intake manifold in fluid communication with said open ports, comprising:

a replacement cylinder head for supporting said exhaust valve means having a partition isolating at least one of said exhaust valve means in a first space and the remainder of said exhaust valve means in a separate second space, a replacement cam for controlling said at least one exhaust valve means in said first space, and an extension duct for fluidly connecting said intake manifold to said first space of said replacement cylinder head.

2. The conversion package of claim 1, further comprising means preventing open ports in said cylinder sidewalls.

3. A method of converting a two cycle internal combustion engine having a piston reciprocable in a cylinder, said cylinder having a cylinder head opposed from said piston to define a chamber therebetween and sidewalls formed with open ports controlled by said piston, a plurality of exhaust valve means for said chamber supported in said cylinder head controlled by cams on a rotating cam shaft, a fuel injection means in said cylinder head, and an air intake manifold in fluid communication with said open ports, comprising:

replacing said cylinder head with a new cylinder head for supporting said exhaust valve means having a partition isolating at least one of said exhaust valve means in a first space and the remainder of said exhaust valve means in a separate second space, replacing said respective cam controlling said at least one exhaust valve means in said first space with a new cam having a profile for operating said at least one exhaust valve means for air intake into said chamber, and providing a further flow passage for connecting said intake manifold to said first space in said new cylinder head.

4. The method of claim 3, further comprising: providing means preventing open ports in said cylinder sidewalls.

* * * * *